US009115571B2

(12) United States Patent
Brennan, III

(10) Patent No.: US 9,115,571 B2
(45) Date of Patent: Aug. 25, 2015

(54) PACKER INCLUDING SUPPORT MEMBER WITH RIGID SEGMENTS

(71) Applicant: Schlumberger Technology Corporation, Sugar Land, TX (US)

(72) Inventor: William E. Brennan, III, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 426 days.

(21) Appl. No.: 13/721,567

(22) Filed: Dec. 20, 2012

(65) Prior Publication Data

US 2014/0174758 A1 Jun. 26, 2014

(51) Int. Cl.
*E21B 49/10* (2006.01)
*E21B 33/12* (2006.01)

(52) U.S. Cl.
CPC ..... *E21B 49/10* (2013.01); *E21B 33/12* (2013.01)

(58) Field of Classification Search
CPC ..... E21B 49/10; E21B 33/12; E21B 33/1208
See application file for complete search history.

(56) References Cited

U.S. PATENT DOCUMENTS 3,452,592 A * 7/1969 Voetter ..... 73/152.26
6,230,557 B1 5/2001 Ciglenec et al.
6,301,959 B1 10/2001 Hrametz et al.
6,658,930 B2 12/2003 Abbas
6,729,399 B2 5/2004 Follini et al.
7,114,385 B2 10/2006 Fisseler et al.
7,114,562 B2 10/2006 Fisseler et al.
7,121,338 B2 10/2006 van Zuilekom et al.
7,128,144 B2 10/2006 Fox et al.
7,395,879 B2 7/2008 Segura et al.
7,584,655 B2 9/2009 van Zuilekom et al.
7,584,786 B2 9/2009 Nold, III et al.
7,603,897 B2 10/2009 Gilbert et al.
7,650,937 B2 1/2010 Fox et al.
7,654,321 B2 2/2010 Zazovsky et al.
7,841,406 B2 11/2010 Zazovsky et al.
8,015,867 B2 9/2011 Kerr et al.
8,210,260 B2 7/2012 Milkovisch et al.
8,220,536 B2 * 7/2012 Tao et al. ..... 166/100
8,235,106 B2 8/2012 Fox et al.
2005/0161218 A1 * 7/2005 van Zuilekom et al. ..... 166/264
2007/0151727 A1 7/2007 Tao et al.
2010/0083748 A1 4/2010 Kerr et al.
2010/0132970 A1 6/2010 Axland et al.
2011/0107830 A1 5/2011 Fields et al.
2011/0162836 A1 7/2011 Church (Continued)

OTHER PUBLICATIONS

International Search Report and Written Opinion issued in PCT/US2013/072955 on Mar. 11, 2014; 9 pages.

*Primary Examiner* — Benjamin Fiorello
(74) *Attorney, Agent, or Firm* — Cathy Hewitt; Kenneth L. Kincaid

(57) ABSTRACT

A downhole tool for a wellbore within a geological formation may include a housing to be lowered into the wellbore, a probe carried by the housing, and a packer carried by the probe. The packer may include a rigid base, an elastomeric member carried by the rigid base and having a recess therein, and a support member within the recess and comprising a plurality of rigid segments interconnected to allow relative movement between adjacent rigid segments. The rigid base, the elastomeric member, and the support member may each have respective aligned openings therein defining a fluid sampling inlet.

20 Claims, 4 Drawing Sheets

(56) References Cited

U.S. PATENT DOCUMENTS

2012/0152533 A1 6/2012 Hoefel et al.
2012/0292024 A1 11/2012 Fox et al.
2013/0213645 A1* 8/2013 Proett et al. ..... 166/250.17
2014/0174721 A1* 6/2014 Brennan, III ..... 166/179

* cited by examiner

PACKER INCLUDING SUPPORT MEMBER WITH RIGID SEGMENTS

BACKGROUND

Wellbores are drilled in geological formations (on land or offshore) to locate and recover hydrocarbons. A downhole drilling tool with a bit at an end thereof is advanced into the ground to form the wellbore. As the drilling tool is advanced, a drilling mud is pumped through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. These samples or tests may be used, for example, to locate and evaluate valuable hydrocarbons.

Formation evaluation often involves drawing fluid from the formation into the downhole tool for testing and/or sampling. Various devices, such as probes, are extended from the downhole tool to establish fluid communication with the formation surrounding the wellbore and draw fluid into the downhole tool. A probe is an element that may be extended from the downhole tool and positioned against the sidewall of the wellbore. A packer at the end of the probe is used to create a seal with the wall of the formation. The mudcake lining the wellbore is often useful in assisting the packer in making the seal. Once the seal is made, fluid from the formation is drawn into the downhole tool through an inlet in the probe by lowering the pressure in the downhole tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool for a wellbore within a geological formation may include a housing to be lowered into the wellbore, a probe carried by the housing, and a packer carried by the probe. The packer may include a rigid base, an elastomeric member carried by the rigid base and having a recess therein, and a support member within the recess and comprising a plurality of rigid segments interconnected to allow relative movement between adjacent rigid segments. The rigid base, the elastomeric member, and the support member may each have respective aligned openings therein defining a fluid sampling inlet.

A related packer to be carried by a probe on a downhole tool for use within a wellbore in a geological formation is also provided. The packer may include a rigid base to be carried by the probe, an elastomeric member carried by the rigid base and having a recess therein, and a support member within the recess and comprising a plurality of rigid segments interconnected to allow relative movement between adjacent rigid segments. The rigid base, the elastomeric member, and the support member may each have respective aligned openings therein defining a fluid sampling inlet.

A related method is for making a packer to be carried by a probe on a downhole tool for use within a wellbore in a geological formation. The method may include arranging a rigid base, an elastomeric member, and a support member so that the elastomeric member is carried by the rigid base and the support member is carried within a recess of the elastomeric member. The support member may include a plurality of rigid segments interconnected to allow relative movement between adjacent rigid segments. Furthermore, the rigid base, the elastomeric member, and the support member may each have respective aligned openings therein defining a fluid sampling inlet.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime and multiple prime numbers are used to indicate like elements in different embodiments.

Figure 1:
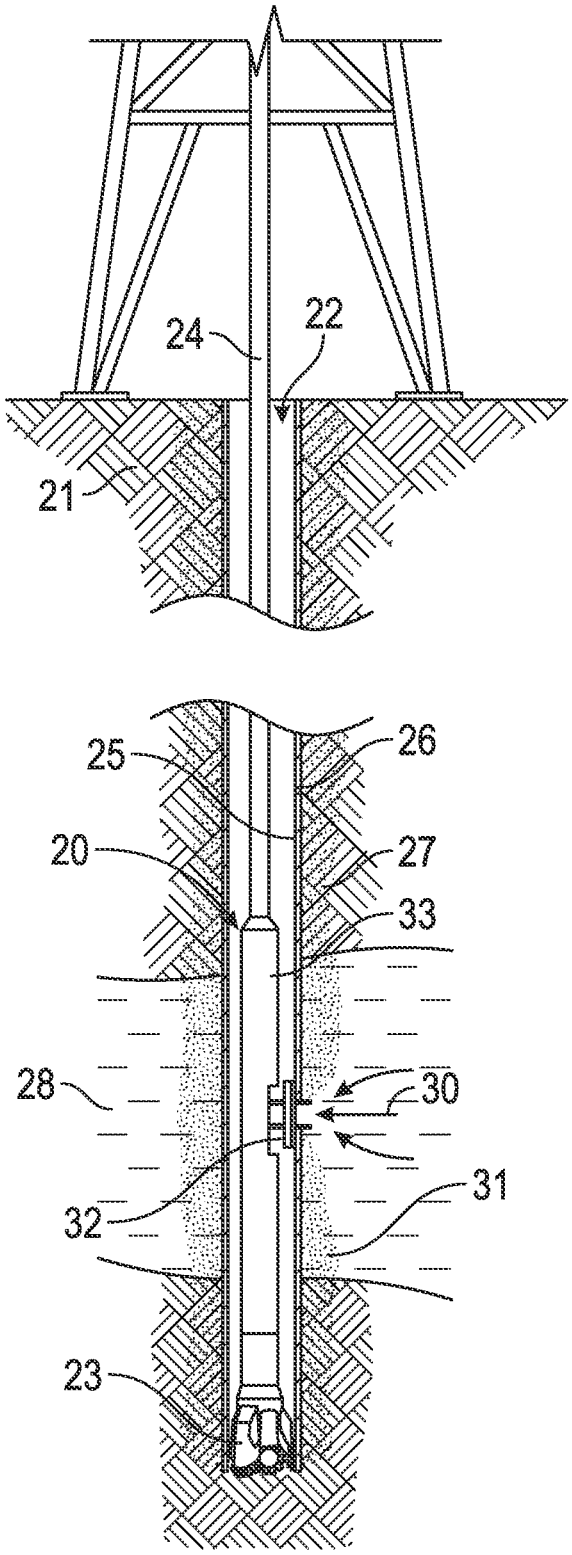
FIG. 1 is a front view, partially in cross-section, of a downhole tool deployed from a rig into a wellbore in accordance with an example embodiment.

Referring initially to FIG. 1, a downhole tool 20 may be advanced into a geological formation 21 (either onshore or offshore) to form a wellbore or borehole 22, which may be used to collect samples from within the borehole. In the illustrated example, the drilling tool 20 has a bit 23 at an end thereof adapted to cut into the formation 21 to form the wellbore 22. That is, in the illustrated example the downhole tool 20 is part of a logging-while-drilling (LWD) or measurement-while-drilling (MWD) implementation, but in other embodiments the downhole tool may be implemented as a wireline device without the drill bit 23, which is lowered into a previously drilled borehole, as will be appreciated by those skilled in the art. However, it will also be appreciated that the packer configurations described herein may also be used in other downhole tools adapted to draw fluid therein, such as coiled tubing, casing drilling and other variations of downhole tools, for example.

The downhole tool 20 is deployed into the wellbore 22 via a drill string 24 in the illustrated example. As the downhole tool 20 is advanced, drilling mud is pumped into the wellbore 22 through the drilling string 24 and out of the bit 23. The mud is circulated up the wellbore 22 and back to the surface for recycling. As the downhole tool 20 advances and mud is pumped into the wellbore 22, the mud may seep into sidewalls 25 of the wellbore 22 and penetrate the surrounding formation. As indicated by reference number 26, the mud lines the wellbore wall 25 and forms a mudcake along the wellbore wall. Mud which penetrates the wall 25 of the wellbore 22 forms an invaded zone 27 along the wellbore wall 25. As shown, the borehole 22 penetrates a formation 28 including a hydrocarbon fluid 30 therein. In the present example, a portion of the drilling mud 26 seeps into the formation 28 along the invaded zone 27 and contaminates the hydrocarbon fluid 30. The contaminated hydrocarbon fluid is indicated by reference number 31.

The downhole tool 20 is provided with a fluid communication device, such as a probe 32. The probe 32 extends from a housing 33 of the downhole tool 20 and carries a packer 34 (see FIG. 2) thereon which forms a seal with the mudcake 26 lining the sidewall 25. The packer 34 may be secured to the probe 32 by bonding, mechanical coupling or other techniques, for example. When samples are to be collected, the probe 32 may be extendable and retractable from the downhole tool 20 by selective activation of one or more pistons, for example (not shown). In other configurations, the probe 32 may remain fixed, and one or more retractable feet (not shown) on an opposite side of the housing 33 from the probe 32 may be used to press the packer 34 into the wall of the 25 of the borehole 22, for example, as will be appreciated by those skilled in the art.

A fluid then flows into the downhole tool 20 via the probe 32 and packer 34, and may be collected in a sampling chamber carried within the housing 33 (although in some embodiments the collected sample material may be transported to the surface via a tube or pipe, for example). A vacuum pump (not shown) may optionally be used to create vacuum pressure to draw the sample material into the sampling chamber through the probe 32 and packer 34. Control of the above-described operations (e.g., probe/vacuum pump actuation, etc.) may be performed remotely from the surface via telemetry or other borehole communication techniques, as will be appreciated by those skilled in the art.

Figure 2:
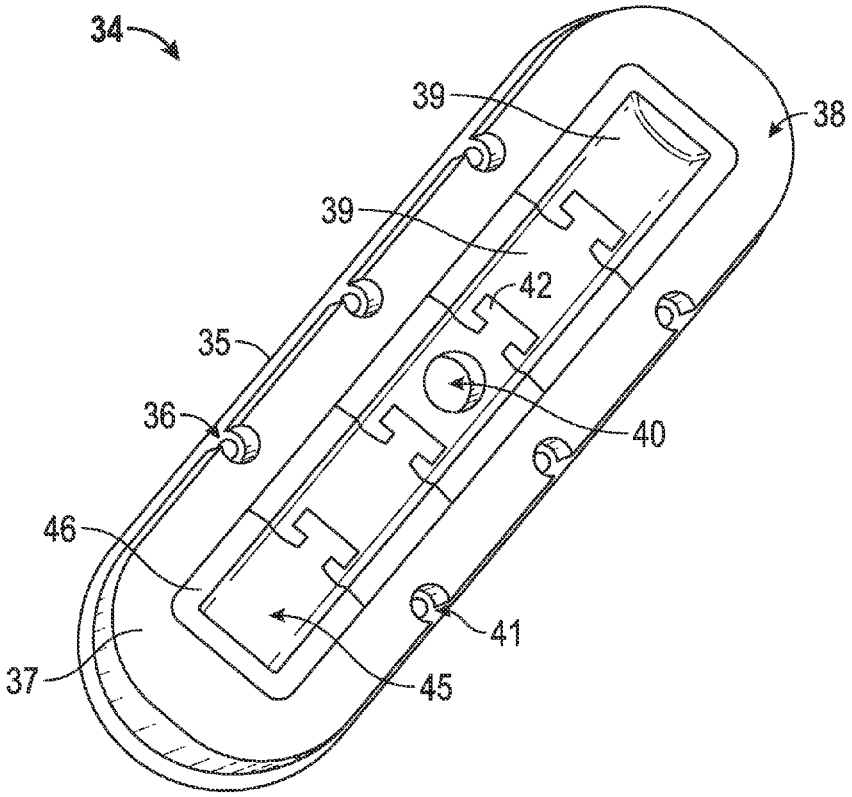
FIG. 2 is a perspective view of an example packer for use with the downhole tool of FIG. 1.
Figure 3:
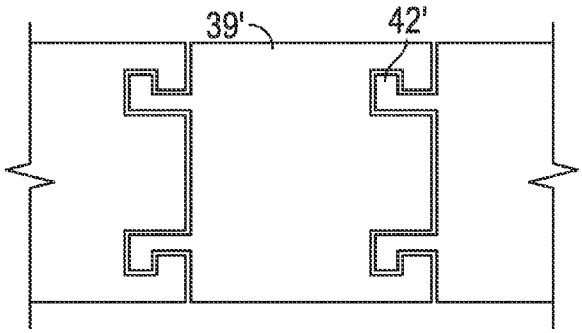
FIG. 3 is a top view of example rigid segments which may be used for the support member of the probe packer of FIG. 2.

An example configuration of the packer 34 is first described with reference to FIGS. 2 and 3. The packer 34 illustratively includes a rigid base 35 to be carried by the probe 32. More particularly, in the illustrated example the rigid base 35 includes a plurality of holes 36 which may be used for securing the rigid base to the packer 32 with bolts or screws, for example. By way of example, the rigid base 35 may be made out of a metal, plastic, or other rigid materials suitable for use within a borehole environment.

An elastomeric member 37 is carried by the rigid base 35 and has a recess therein. By way of example, the elastomeric member 37 may be made from natural rubber, as well as other flexible compounds that are suited to borehole conditions. One such compound is compound 8009 from Maloney Technical Products of Ft. Worth, Tex., although other suitable materials may also be used. In the illustrated example, the elastomeric member 37 has an oval shape. A support member 38 is illustratively carried within the recess of the elastomeric member 37 and includes a plurality of rigid segments 39 which are interconnected to allow relative movement between adjacent rigid segments, as will be discussed further below. The rigid base 35, the elastomeric member 37, and the support member 38 each have respective aligned openings therein defining a fluid sampling inlet 40. By way of example, the fluid sampling inlet 40 may be sized to fit over a probe barrel (not shown) of the packer 32. In the illustrated example, the elastomeric member 37 includes cut-outs 41 respectively corresponding to the holes 36 in the rigid base, although in some embodiments a wider base may be used so that the holes may be spaced apart from the elastomeric member without using cut-outs in the elastomeric member.

The use of multiple rigid segments 39 to form the inlet 40 of the packer 34 may help increase the effective area of the inlet, and also to allow for different shapes for the inlet. This may be helpful as the borehole wall 25 may not be smooth, that is, it may have roughness or irregularities. However, using the support member 38 may help to bridge across these irregularities, leaving gaps, which the elastomeric flexible packer material of the member 37 may not otherwise be able to provide a sufficient seal with for sampling. By using the rigid segments 39, the support member 38 is divided into smaller linked segments which may more readily conform to irregularities of the borehole wall 25, while still providing desired support or rigidity.

More particularly, in the illustrated example the rigid segments 39 include interlocking features. In the example illustrated in FIG. 2, the interlocking features define mating hinge portions, and more particularly respective male key portions 42 and female key portions, which link the rigid segments 39 together to allow relative movement between adjacent rigid segments. Accordingly, this allows the support member 34 to conform to the shape of the borehole 25. In the present example, the male key portions 42 resemble capital "T" shapes, although more than one key, and different shapes of keys, may also be used. In another example illustrated in FIG. 3, each rigid segment 39' includes a pair of L-shaped male key segments 42' which face away from one another as shown. Other key shapes may include pyramids, circle or oval shapes, rectangular or square shapes, etc. The male and female key portions may accordingly define mating hinge portions in some configurations.

Generally speaking, the size of the rigid segments 39 may be determined based upon the expected size and orientation of the borehole irregularities. The rigid segments 39 may take various shapes or sizes, and may allow for relatively free movement of the segments with respect to one another. The elastomeric material may be bonded to the rigid segments 39, which may also help maintain the positioning of the segments in addition to the interlocking features. In an example configuration, the packer 34 may be about 3 inches wide and 8-10 inches long, while the support member 38 may have a width of about 1 inch and a length of about 7 inches for an average borehole diameter (e.g., about 1-2 feet in diameter). However, other dimensions may be used in different embodiments.

The rigid segments 42 when connected together define an elongate support member having a recessed medial portion 45 with raised sidewall portions 46 surrounding the recessed medial portion. Accordingly, when the support member 38 is pressed to conform to the wall 25 of the borehole 22, the raised sidewall portions 46 will cause the recessed medial portion 45 to be spaced apart or "stand off" from the borehole wall, so that sample fluid will flow within the recessed medial portion to the inlet 40.

Figure 4:
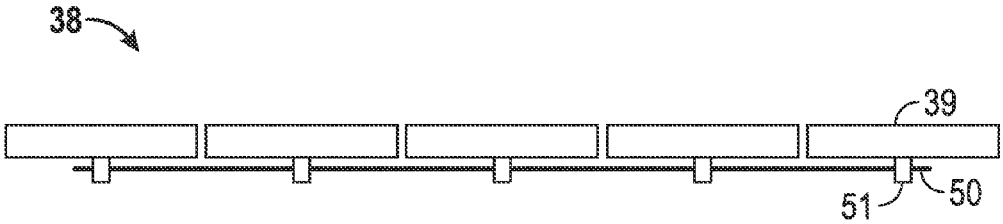
FIG. 4 is a side view showing an example embodiment of the support member of FIG. 2 in which a plurality of rigid segments are interconnected on a bottom side thereof by an elongate member.

Referring now additionally to FIG. 4, in some embodiments, one or more elongate members 50, such as a cable or guide wire, may be used to interconnect the rigid segments 39 in addition to, or instead of, the above-described interlocking features. In the illustrated example, each of the rigid segments 39 has tab 51 on a bottom side thereof through which the elongate member runs. When used along with interlocking features, the elongate member(s) 50 may provide a secondary link between the segments to keep them in their original configuration, and resist movement caused by distortion the packer will go through during the compression experienced during a set. This helps the rigid segments 39 to maintain their relative positioning to one another, and to maintain the original shape of the inlet 50 defined by the segments.

Figure 5:
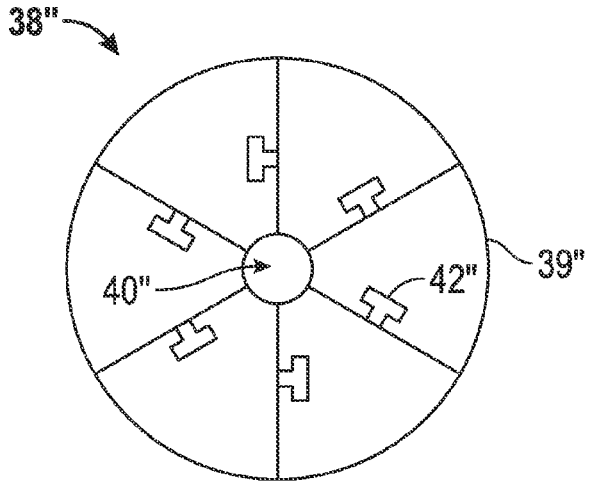
FIGS. 5 and 6 are top views of circular support members in accordance with example embodiments.
Figure 6:
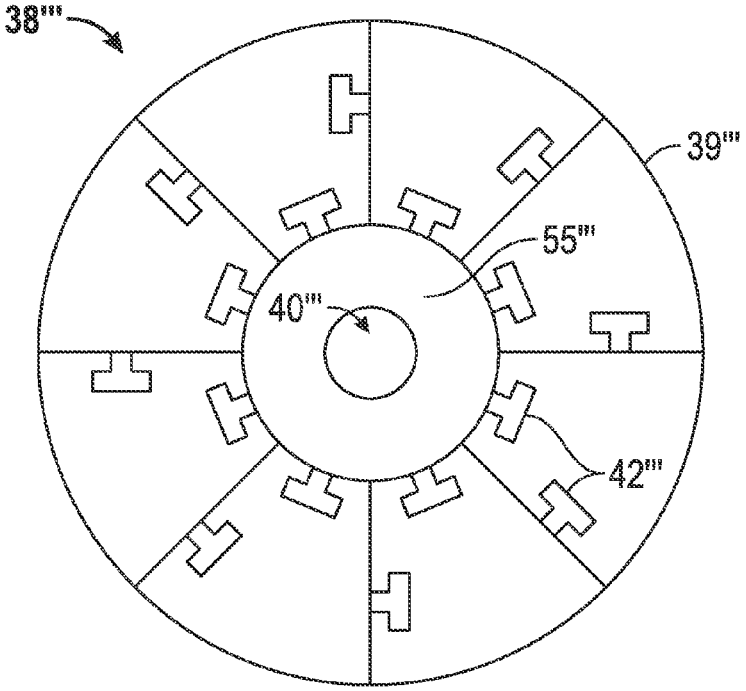
Figure 7:
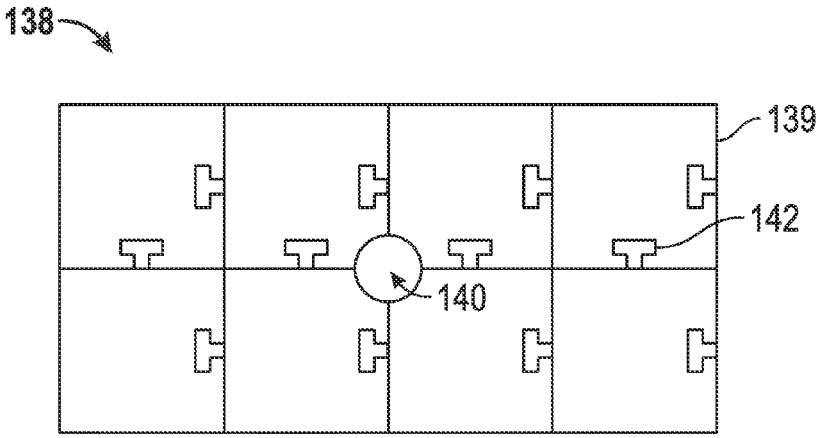
FIG. 7 is a top view of a rectangular support member in accordance with an example embodiment.

Turning now additionally to FIGS. 5 and 6, other support member shapes (as well as elastomeric member shapes) may also be used in different embodiments. In the illustrated examples, circular support members 38" and 38''' are shown. More particularly, the support member 38" illustratively includes six pie-shaped segments 39" defining the central inlet 40". Each rigid segment 39" has a respective male key 42" on one edge and a female key portion on the opposing edge. The support member 38''' is similar, but further includes an inner ring segment 55''' with male keys 42''', while the segments 39''' have male key portions 42''' and female key portions for one another as well as female key portions for the male key portions of the inner ring member. Another example embodiment is shown in FIG. 7, in which a rectangular support member 138 illustratively includes a plurality of square interlocking rigid segments 139 with respective male key portions 142 and female key portions which define an inlet 140. As with the support member 38, these configurations may similarly include raised sidewall/recessed trough features, for example, to allow sample fluid movement to the inlet of the given packer.

Figure 8:
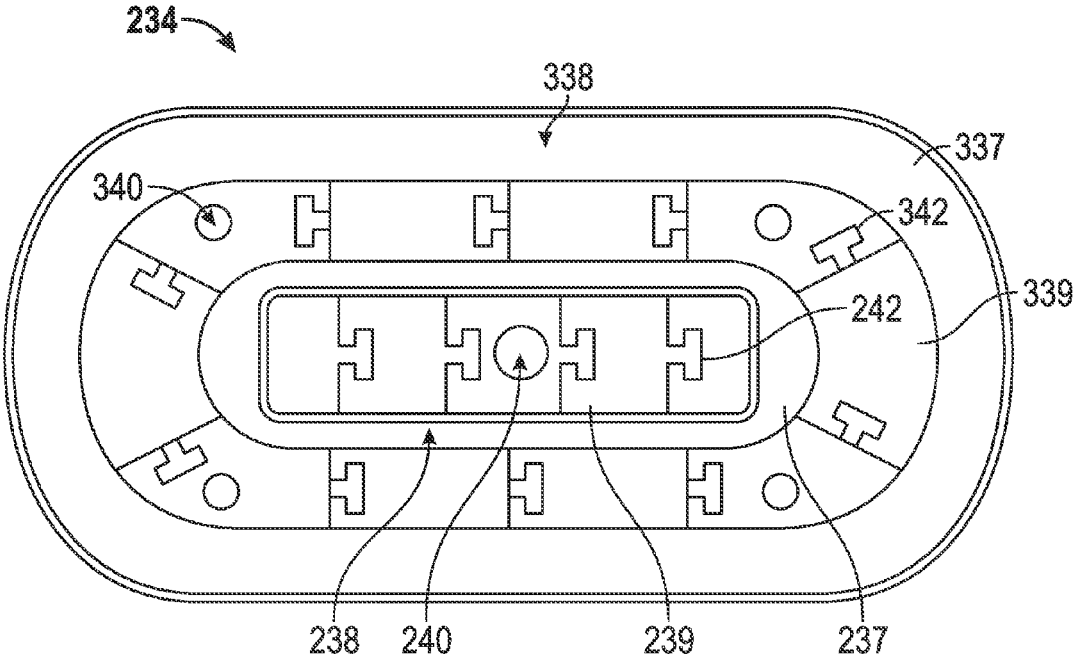
FIG. 8 is a top view of an oval support member in accordance with an example embodiments.

Still another example packer 234 is shown in FIG. 8, in which multiple support members are used. More particularly, an elliptical support member 338 is carried within a first elastomeric support member 337. The elliptical support member 338 illustratively includes a plurality of rigid segments 339 having respective male key portions 342 and female key portions, and optionally defines one or more fluid inlets 340. A second elastomeric member 237 is carried within the first elliptical support member 338, and an elongate rigid support member 238 is carried by the second elastomeric member. Similar to the support member 38 described above with respect to FIG. 2, the elongate support member 238 illustratively includes a plurality of rigid segments 239 having respective male key portions 242 and female key portions, and defines a inlet 240.

Accordingly, it will be appreciated that various inlet shapes and configurations may be provided using the segmented approach set forth herein. Generally speaking, the segmented support members may be particularly beneficial for larger inlets, as it may otherwise be difficult to maintain good contact with an irregular borehole wall with elastomeric packers alone. The segmented configurations described above may also allow for use with a wider range of borehole sizes, since the rigid segments may allow the inlet to more readily conform to the borehole shape.

In one example embodiment, the packer 34 may be manufactured by positioning the rigid base 35 and the support member 38 in a mold, and rubber or other elastomeric material may be injected between those elements, and bonded to them, to form the support member 37. However, it should be noted that in some embodiments the support member 38 may be added after molding of the elastomeric member 37 is complete.

More particularly, the rigid segments 39 may be mechanically bonded together with an adhesive, or with small points of weld or brazing, or other suitable bonding approach. This allows the support member 38 to maintain its intended final shape through the molding process. The adhesive or small weld points may be made weak enough to allow the segments to break apart with use, for example. If the rigid segments 39 are machined out of a single piece of material, for example, very thin webs of material may be left between the segments. A secondary operation may also be performed after molding to break the rigid segments 39 apart, if desired.

While the above-noted packer designs were described with reference to probe packers, it should be noted that other configurations may also be used. For example, the support members described above may also be used with inflatable packer elements as well.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A downhole tool for a wellbore within a geological formation comprising:
- a housing to be lowered into the wellbore;
- a probe carried by said housing; and
- a packer carried by said probe and comprising
  - a rigid base,
  - an elastomeric member carried by said rigid base and having a recess therein, and
  - a support member within the recess and comprising a plurality of rigid segments interconnected to allow relative movement between adjacent rigid segments,
  - said rigid base, said elastomeric member, and said support member each having respective aligned openings therein defining a fluid sampling inlet.

2. The downhole tool of claim 1 wherein said plurality of rigid segments comprise mating hinge portions.

3. The downhole tool of claim 2 wherein said plurality of mating hinge portions comprise respective mating male and female key portions.

4. The downhole tool of claim 1 further comprising at least one elongate member interconnecting said plurality of rigid segments.

5. The downhole tool of claim 1 wherein said support member has a recessed medial portion and raised sidewall portions surrounding said recessed medial portion.

6. The downhole tool of claim 1 wherein said elastomeric member has an oval shape.

7. The downhole tool of claim 1 wherein said support member has an elongate shape.

8. The downhole tool of claim 1 wherein said support member has a circular shape.

9. A packer to be carried by a probe on a downhole tool for use within a wellbore in a geological formation, the packer comprising:
- a rigid base to be carried by the probe;
- an elastomeric member carried by said rigid base and having a recess therein; and
- a support member within the recess and comprising a plurality of rigid segments interconnected to allow relative movement between adjacent rigid segments;
- said rigid base, said elastomeric member, and said support member each having respective aligned openings therein defining a fluid sampling inlet.

10. The packer of claim 9 wherein said plurality of rigid segments comprise mating hinge portions.

11. The packer of claim 10 wherein said plurality of mating hinge portions comprise respective mating male and female key portions.

12. The packer of claim 9 further comprising at least one elongate member interconnecting said plurality of rigid segments.

13. The packer of claim 9 wherein said support member has a recessed medial portion and raised sidewall portions surrounding said recessed medial portion.

14. The packer of claim 9 wherein said elastomeric member has an oval shape.

15. The packer of claim 9 wherein said support member has an elongate shape.

16. The packer of claim 9 wherein said support member has a circular shape.

17. A method for making a packer to be carried by a probe on a downhole tool for use within a wellbore in a geological formation, the method comprising:

arranging a rigid base, an elastomeric member, and a support member so that the elastomeric member is carried by the rigid base and the support member is carried within a recess of the elastomeric member;

the support member comprising a plurality of rigid segments interconnected to allow relative movement between adjacent rigid segments;

the rigid base, the elastomeric member, and the support member each having respective aligned openings therein defining a fluid sampling inlet.

18. The method of claim 17 wherein the plurality of rigid segments comprise mating hinge portions.

19. The method of claim 18 wherein the plurality of mating hinge portions comprise respective mating male and female key portions.

20. The method of claim 17 further comprising interconnecting the plurality of rigid segments with at least one elongate member.

* * * * *